US008113917B2

(12) United States Patent
Yan et al.

(10) Patent No.: US 8,113,917 B2
(45) Date of Patent: Feb. 14, 2012

(54) GRINDING STRUCTURE HAVING MICRO BALL

(75) Inventors: Biing-Hwa Yan, Kaohsiung City (TW); Jung-Chou Hung, Fongshan (TW); Shao-Chun Lien, Yangmei (TW)

(73) Assignee: National Central University, Taoyuan County (TW)

( * ) Notice: Subject to any disclaimer, the term of this patent is extended or adjusted under 35 U.S.C. 154(b) by 144 days.

(21) Appl. No.: 11/822,434

(22) Filed: Jul. 5, 2007

(65) Prior Publication Data

US 2010/0216377 A1 Aug. 26, 2010

(51) Int. Cl.
*B24D 18/00* (2006.01)

(52) U.S. Cl. ..... 451/56; 51/307

(58) Field of Classification Search ..... 451/541, 451/548, 540, 56; 51/293, 307, 308
See application file for complete search history.

(56) References Cited

U.S. PATENT DOCUMENTS

| | | | | | |
|---|---|---|---|---|---|
| 477,225 | A | * | 6/1892 | Rauhe | 433/165 |
| 2,562,587 | A | * | 7/1951 | Swearingen | 433/166 |
| 2,978,846 | A | * | 4/1961 | Barron | 451/541 |
| 3,309,772 | A | * | 3/1967 | Lieb et al. | 433/166 |
| 4,058,898 | A | * | 11/1977 | Nash | 433/166 |
| 4,661,064 | A | * | 4/1987 | Beltramini | 433/166 |
| 4,684,346 | A | * | 8/1987 | Martin | 433/166 |
| 4,834,655 | A | * | 5/1989 | Kyotani | 433/166 |

* cited by examiner

*Primary Examiner* — Robert Rose
(74) *Attorney, Agent, or Firm* — Jackson IPG PLLC; Demian K. Jackson

(57) ABSTRACT

A micro-grinding device with a micro ball at an end is made. The micro ball is deposited with grinding particles. The grinding device is able to grind a surface having an arc degree more than 180 degrees. Thus, the present invention is suitable to be used for forming micro molds, removing burr, and micro-milling, micro-paring or micro-grinding a surface.

5 Claims, 5 Drawing Sheets

GRINDING STRUCTURE HAVING MICRO BALL

FIELD OF THE INVENTION

The present invention relates to a grinding structure; more particularly, relates to melting a peak point of a micro device shaft into a micro ball with grinding particles deposited through composite electroplating.

DESCRIPTION OF THE RELATED ARTS

Technologies are advancing. Micro-molds and micro-machining are much more requested day by day.

Take micro-devices in micro electro-mechanical systems (MEMS) as examples. They include micro-shafts, micro-pores, micro-channels, etc.; and are obtained through micro machining. Thus, micro-machining becomes important.

Technologies for micro-machining includes laser machining, electro beam machining (EBM), ultrasonic machining (USM), ion beam machining (IBM), etching, electrical discharge machining (EDM), etc. Among them, the EDM is a low-cost machining for any hard and stretching conductive material, and can be used with other machining technology, like high-frequency magnetic grinding, electro-chemical machining (ECM), magnetic abrasive grinding, etc.

For forming a micro-tool, most researches are aiming at circular pillars, triangle pillars, tetragonal pillars, pin tools, etc., where tool with micro-ball in front is rare. A prior art of a punch is obtained from a pin electrode to form a micro ball through EDM. Another prior art uses EDM to fabricate a shaft with a micro ball at a front end of a micro pure tungsten electrode. For the micro ball has a diameter of 40 mm and the shaft has a diameter of 30 mm with a length of 300 mm, the prior art is merely used as a probe owing to the big aspect ratio.

A general ball cutter is fabricated through milling with a diamond grinder to be processed through a coating for obtaining the cutter. Besides, for a general diamond grinding tool, a diamond film is grown on a surface of the high-quality tool through a chemical vapor deposition (CVD). Although the diamond film obtained through the CVD is good in strength, uniformity and density, its fabricating cost is high. Hence, the prior arts do not fulfill all users' requests on actual use.

SUMMARY OF THE INVENTION

The main purpose of the present invention is to obtain a grinding structure having a micro ball for precise machining through micro-milling and micro-paring.

To achieve the above purpose, the present invention is a grinding structure having a micro ball, where a micro device shaft is selected to be machined to obtain a peak point at an end surface; then a high-density power is inputted to melt the peak point to obtain a micro ball having a core material; and then the micro device shaft is processed through composite electroplating to deposit grinding particles on a surface of the micro device shaft in a base material. Accordingly, a novel grinding structure having a micro ball is obtained.

BRIEF DESCRIPTIONS OF THE DRAWINGS

The present invention will be better understood from the following detailed description of the preferred, embodiment according to the present invention, taken in conjunction with the accompanying drawings, in which FIG. 1 is the flow view showing the preferred embodiment according to the present invention;

DESCRIPTION OF THE PREFERRED EMBODIMENT

The following description of the preferred embodiment is provided to understand the features and the structures of the present invention.

Figure 1:
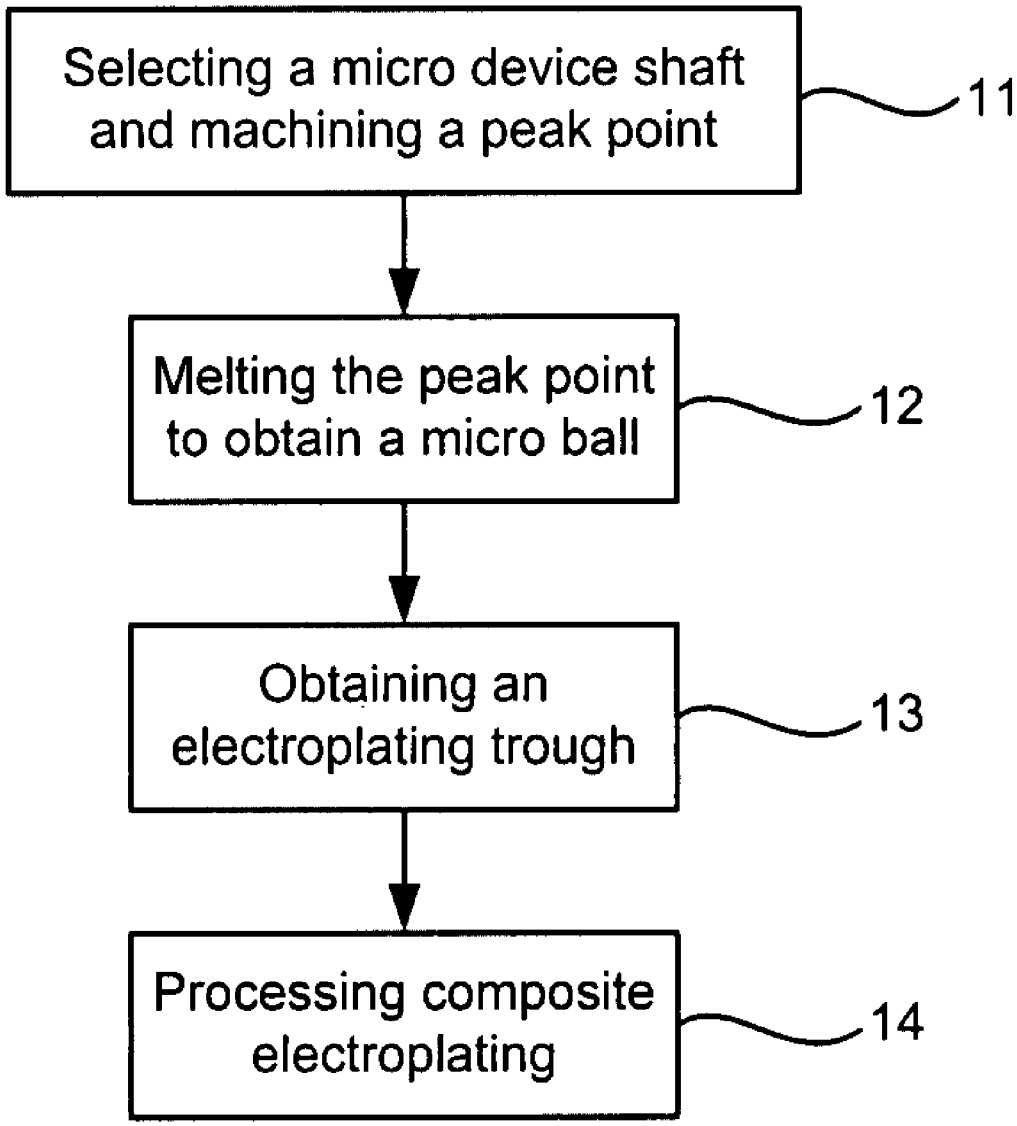
Figure 2:
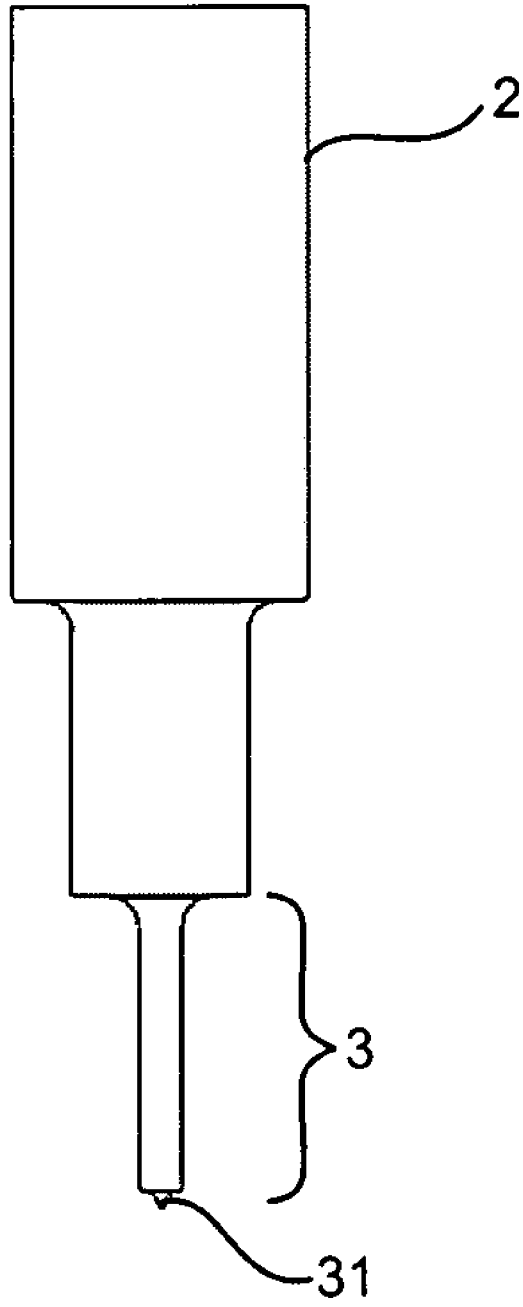
FIG. 2 is the view showing the micro device shaft having the peak point.

Please refer to FIG. 1 to FIG. 5, which are a flow view showing the preferred embodiment according to the present invention; views showing a micro device shaft having a peak point and one having a micro ball; a view showing an electroplating trough; and a view showing composite electroplating. As shown in the figures, the present invention is a grinding structure having a micro ball, comprising the following steps:

(a) Selecting a micro device shaft and machining a peak point 11: As shown in FIG. 2, a machining handle 2 has a micro device shaft 3 selected at an end to be machined to a required size and to obtain a peak point 31 at center of a front end of the micro device shaft 3.

Figure 3:
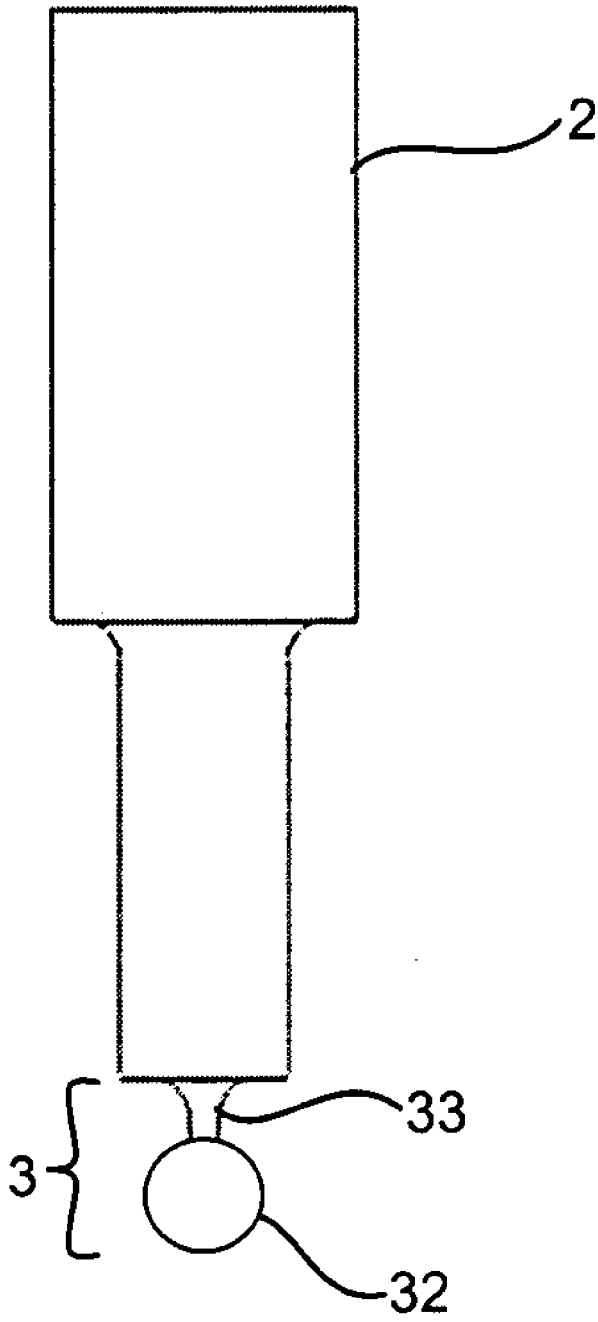
FIG. 3 is the view showing the micro device shaft having the micro ball.

(b) Melting the peak point to obtain a micro ball 12: As shown in FIG. 3, a high-density power is inputted to melt the peak point 31 of the micro device shaft 3 to form a micro ball 32. Thus, a micro device shaft 3 having a micro ball 32 and a micro handle 33 is formed, where the micro ball 32 has a core material of tungsten, tungsten carbide, high speed steel or tungsten steel; the micro ball 32 has a diameter between and 300 millimeters (mm); and diameter of the micro handle 33 is smaller or equal to that of the micro ball 32.

Figure 4:
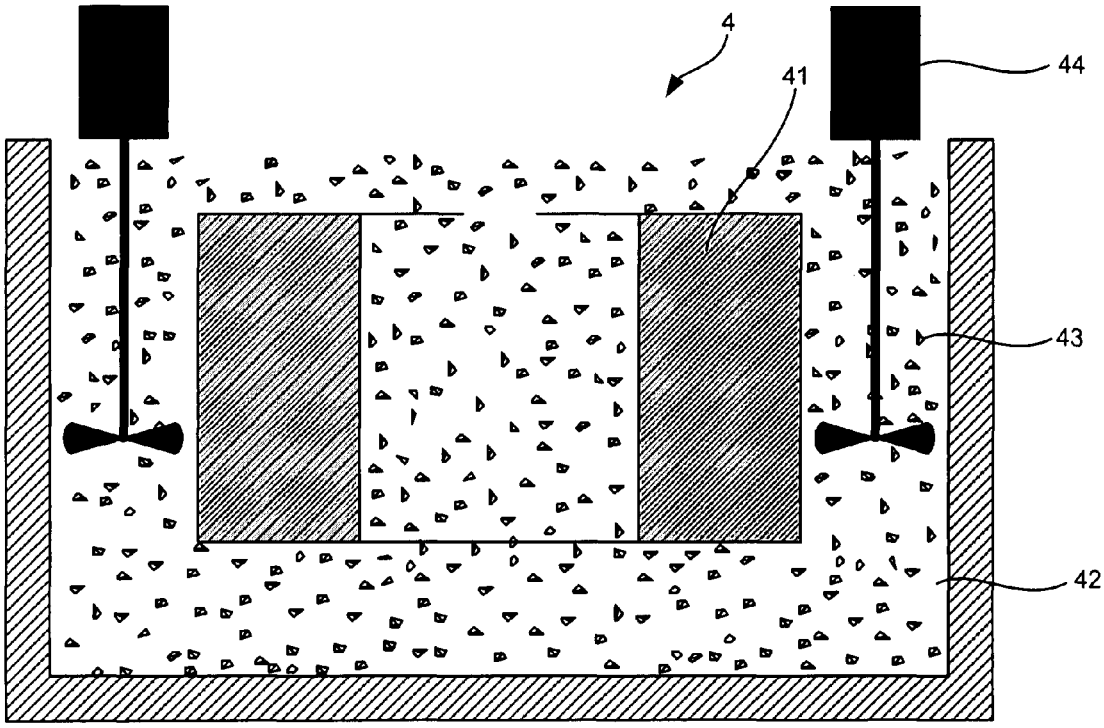
FIG. 4 is the view showing the electroplating trough.

(c) Obtaining an electroplating trough 13: As shown in FIG. 4, an electroplating trough 4 is obtained to contain an electroplating solution 43 having an amount of grinding particles uniformly distributed, where the grinding particle 42 is made of diamond, SiC, polycrystalline cubic boron nitride (PCBN) or $Al_2O_3$; and the grinding particle 42 has a diameter between 0.1 to 10 mm.

Figure 5:
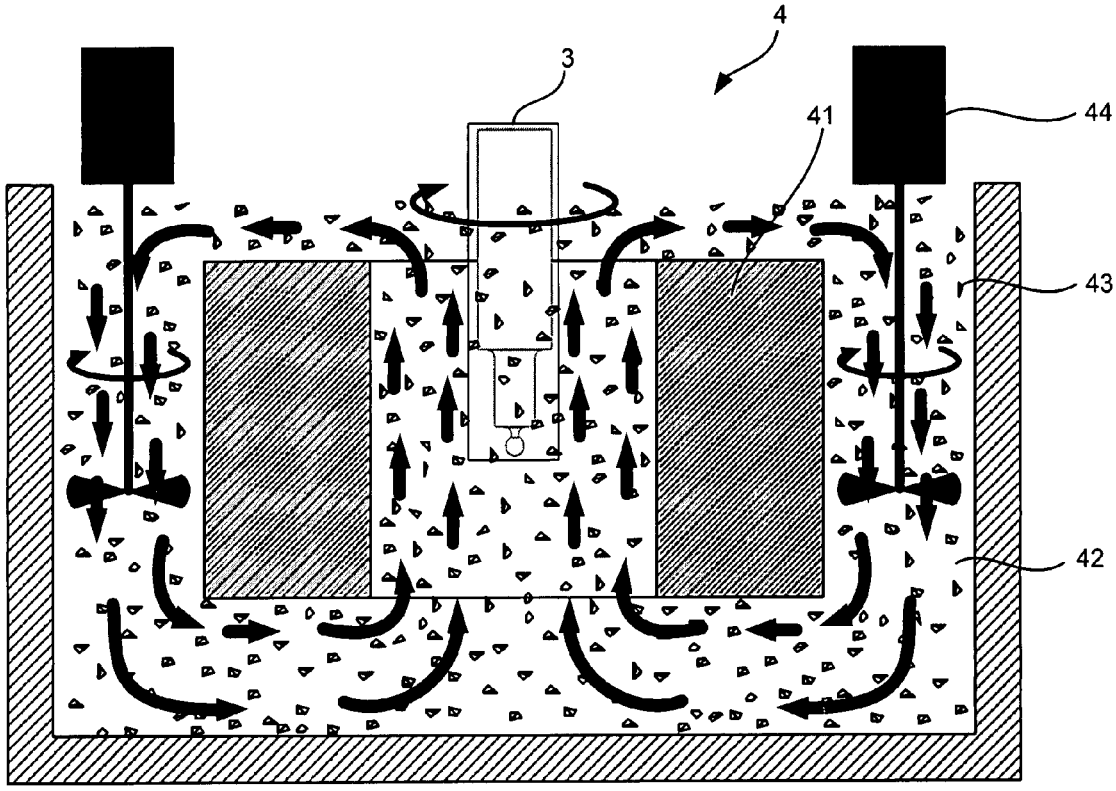
FIG. 5 is the view showing the composite electroplating.

(d) Processing composite electroplating 14: As shown in FIG. 5, a composite electroplating is processed to deposit the grinding particles 42 together with a base material to form a composite electroplated metal layer on a surface of the micro device shaft 3, where the base material is Ni, Cr, Cu, Al, Ag, Zn or an alloy of any of the above metals.

After the composite electroplating, the micro device shaft can be further cleansed to remove the electroplating solution 43 left on the surface, where the cleansing is an ultrasonic cleansing or an electrolysis.

Through the above steps, the grinding structure 5 having the micro ball is obtained. The present invention has advantages on a mass-production, a simple process, a low cost and a high quality; and is used to form micro molds, to remove burr, to micro-mill, micro-pare or to micro-grind a surface, like micro-machining a concave ball mold, a printed circuit board (PCB), a micro-channel for bio-medical diagnosis, a micro electro-mechanical system (MEMS), etc., so that a surface obtained after machining is smooth and requires not second machining. Besides, the present invention can be operated on a surface having an arc degree more than 180 degrees, bigger than the arc degree of surface of a normal grinding device.

On using the present invention, a micro device shaft 3 obtains a required shape and a required size through a machining, like electrical discharge machining (EDM), electro-chemical machining (ECM), etching, laser machining or electro beam machining (EBM), etc. An end surface of the micro device shaft 3 is refined through EDM to be flat and smooth. The micro device shaft 3 is processed with a rough machining to roughly obtain the required diameter. Then the micro device shaft 3 is finely machined to exactly obtain the required diameter. At last, a peak point 31 is formed at center of the end surface of the micro device shaft 3.

The EDM is then continued on processing to the micro device shaft 3. A discharging with a high-density power is generated at the peak point until the peak point 31 is melted at a high temperature and a micro ball 32 is obtained before stopping the EDM. Then, the micro ball 32 can be further machined to obtain a micro-furrow on a surface to contain odds and ends and to remove them. During the discharging, the peak point 31 is positioned at center of the end surface of the micro device shaft 3 so that a core of the micro ball 32 is not deviated since the discharging happens where the distance is the shortest between the corresponding electrodes.

Then an electroplating trough 4 is obtained, where the electroplating trough 4 has a surrounding anode 41 and the micro device shaft 3 is sunk in the electroplating solution 43. Under various parameters for machining, grinding particles 42 having diameters between 2 and 4 mm are used for electroplating. Two stirrers 44 are provided separately at two sides of the electroplating trough to keep the grinding particles 42 floating in the electroplating solution 43; and a surfactant is added in the electroplating solution 43 to improve a distribution and a deposition of the grinding particles 42. After the deposition by the composite electroplating is finished, the electroplating solution 43 left on the surface of the micro device shaft 3 is removed by cleansing. Thus, a novel grinding structure 5 having a micro ball is obtained.

To sum up, the present invention is a grinding structure having a micro ball, where micro-milling and micro-paring are processed with the present invention to obtain a smooth surface; and the present invention has advantages on a mass-production, a simple process, a low cost and a high quality.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A fabricating method for forming a grinding device having a micro ball comprising steps of:

(a) forming a micro device shaft of a requested size and with a peak point at a center of a front end surface of said micro device shaft;

(b) inputting a high-density power to melt said peak point of said micro device shaft and solidifying said melted peak point to obtain a micro ball having a diameter larger than the device shaft and the micro ball having a core material and an arc degree more than 180 degrees;

(c) obtaining an electroplating trough, said electroplating trough having a compound electroplating solution, said electroplating solution having an amount of grinding particles and a base material wherein said base material is selected from a group consisting of Cu, Al, Ag, Zn and an alloy of any of above said metals; and (d) processing a composite electroplating to deposit said grinding particles and base material on a surface of said micro device shaft to obtain a composite electroplated layer comprising the grinding particles and the base material.

2. The method of claim 1, wherein a cleansing is further processed to said surface of said micro device shaft after said composite electroplating to remove said electroplating solution left on said surface of said micro device shaft.

3. The method of claim 2, wherein said cleansing is selected from a group consisting of an ultrasonic cleansing and an electrolysis.

4. The method of claim 1, wherein a micro furrow is further formed on said surface of said micro ball.

5. The method of claim 1, wherein said high-density power is obtained in an operation selected from a group consisting of electrical discharge machining (EDM), electro-chemical machining (ECM), etching, laser machining and electro beam machining (EBM).

* * * * *